US007209086B2

(12) United States Patent
Chung

(10) Patent No.: US 7,209,086 B2
(45) Date of Patent: Apr. 24, 2007

(54) ANTENNA DEVICE FOR PORTABLE TERMINAL

(75) Inventor: Hyung-Jin Chung, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 2 days.

(21) Appl. No.: 11/239,871

(22) Filed: Sep. 30, 2005

(65) Prior Publication Data

US 2006/0097929 A1 May 11, 2006

(30) Foreign Application Priority Data

Nov. 10, 2004 (KR) ..... 10-2004-0091403

(51) Int. Cl.
*H01Q 1/24* (2006.01)

(52) U.S. Cl. ..... 343/702; 455/575.4

(58) Field of Classification Search ..... 343/702; 455/575.4

See application file for complete search history.

(56) References Cited

U.S. PATENT DOCUMENTS 6,208,874 B1 * 3/2001 Rudisill et al. ..... 455/575.4
6,961,593 B1 * 11/2005 Lonka et al. ..... 455/573
6,980,840 B2 * 12/2005 Kim et al. ..... 455/575.4
7,106,260 B2 * 9/2006 Ryu et al. ..... 343/702
2002/0137476 A1 * 9/2002 Shin ..... 455/90

* cited by examiner

*Primary Examiner*—Hoang V. Nguyen
(74) *Attorney, Agent, or Firm*—The Farrell Law Firm

(57) ABSTRACT

Disclosed is an antenna device for a portable terminal including a first housing and a second housing which is slidably assembled with the first housing so as to open and close a part of the first housing. The antenna device includes an antenna pattern which is disposed on an inner surface of the second housing, the second housing enclosing the first housing when the first housing and the second housing have been assembled with each other; and a flexible printed circuit which extends from the antenna pattern into the first housing. In the antenna device, since the antenna pattern is connected to a main board of the portable terminal by means of the flexible printed circuit, the stable connection of the antenna pattern and the main board can be kept.

9 Claims, 7 Drawing Sheets

ANTENNA DEVICE FOR PORTABLE TERMINAL

PRIORITY

This application claims priority to an application entitled "Antenna Device for Portable Terminal" filed with the Korean Intellectual Property Office on Nov. 10, 2004 and assigned Serial No. 2004-91403, the contents of which are incorporated herein by reference.

BACKGROUND OF THE INVENTION

1. Field of the Invention

The present invention relates to a portable terminal including digital communication devices such as a cellular phone, Personal Digital Assistants (PDA), a hand held phone, a camera phone, a game phone, an internet phone, etc., and more particularly to an antenna device for a portable terminal of which transmitting and receiving sensitivity can be controlled as the antenna device is moved slidably on the portable terminal.

2. Description of the Related Art

In general, "a portable terminal" means an electronic device which a user can carry while communicating with another user in radio. In consideration of portability, design of such a portable terminal has been directed not only toward compactness, slimness and lightness, but also toward providing multimedia capabilities to allow the user to pursue a variety of functions. In particular, future portable terminals will be not only used for many functions and purposes despite compactness and lightness, but also be modified to be suitable for functioning in a multimedia environment and for providing internet access and functions. Additionally, such portable terminals may be used by men and women, young and old, anywhere in the world.

Conventional portable terminals may be classified into various types according to their appearance, such as bar-type portable terminals, flip-type portable terminals, and folder-type portable terminals. The bar-type portable terminal has a single housing shaped like a bar. The flip-type portable terminal has a flip which is pivotably mounted to a bar-shaped housing by a hinge unit. The folder-type portable terminal has a folder coupled to a single bar-shaped housing by a hinge unit in such a manner that the folder can be rotated in order to be folded to or unfolded from the housing.

Further, portable terminals may be classified as neck wearable type terminals and wrist wearable type terminals, according to the position at or the way in which a user puts on the terminal. The neck wearable type terminal is one which a user wears around the neck using a lanyard or cord, while the wrist wearable type terminal is one which a user wears around the wrist.

Additionally, portable terminals may be classified as rotation-type terminals and sliding-type terminals according to ways of opening and closing the terminals. In the rotation-type portable terminal, two housings are coupled to each other in a manner that one housing rotates to be opened or closed relative to the other while facing each other. In the sliding-type portable terminal, two housings are coupled to each other in a manner that one housing slides to be opened or closed relative to the other. The various classifications of portable terminals are easily understood by those skilled in the art.

Further, each of the conventional portable terminals enumerated above has been converted so as to allow voice communication, as well as a high-speed data communication. That is, as consumer demands have increased, various services have been provided using wireless communication technology for transmitting and receiving data at a high speed.

It is a present tendency that a camera lens is mounted to the portable terminal, and that it is possible to transmit image signals and the like. Present portable terminals may be provided with an embedded or external camera lens module. Therefore, it is possible to perform image communication with a desired partner or to photograph a desired subject.

On the other hand, the conventional portable terminals commonly have an antenna device, in order to secure a high transmitting and receiving rate and a good signal quality. Conventionally, such an antenna device of a portable terminal has an extendible and retractable antenna such as a helical antenna and a rod type antenna. However, the above-mentioned portable terminal causes the user inconvenience because the rod antenna must be extended or retracted from the terminal whenever radio reception is decreased. Also, it is inconvenient to the user to hold the portable terminal in user's pocket due to the protruding antenna, resulting in diminished portability of the portable terminal. In particular, there is a problem in that the portable terminal may often be broken if dropped.

In the case where the conventional portable terminal has an internal antenna which is fixed inside a body of the portable terminal, it is convenient for a user to carry the portable terminal. However, the portable terminal has a disadvantage in that the radio reception of the internal antenna is deteriorated under poor radio wave environments due to terrestrial interference and other environmental factors.

SUMMARY OF THE INVENTION

Accordingly, the present invention has been made to solve the above-mentioned problems occurring in the prior art, and an object of the present invention is to provide an antenna device for a portable terminal of which the stability and reliability can be improved by preventing damage of a flexible printed circuit connecting a main board and the antenna device installed in a separate housing.

Another object of the present invention is to provide an antenna device for a portable terminal, which is disposed in the portable terminal and whose length can be adjusted according to wave receiving sensitivity.

Still another object of the present invention is to provide an antenna device for a portable terminal, whose wave receiving sensitivity can be controlled by slidably moving the antenna device along the portable terminal.

In order to accomplish these objects, there is provided an antenna device for a portable terminal including a first housing and a second housing which is slidably assembled with the first housing so as to open and close a part of the first housing, the antenna device including an antenna pattern which is disposed on an inner surface of the second housing, the second housing enclosing the first housing when the first housing and the second housing have been assembled with each other; and a flexible printed circuit which extends from the antenna pattern into the first housing.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENT

Hereinafter, preferred embodiments of the present invention will be described with reference to the accompanying drawings. In the following description of the present invention, a detailed description of known functions and configurations incorporated herein is omitted to avoid making the subject matter of the present invention unclear.

Figure 1:
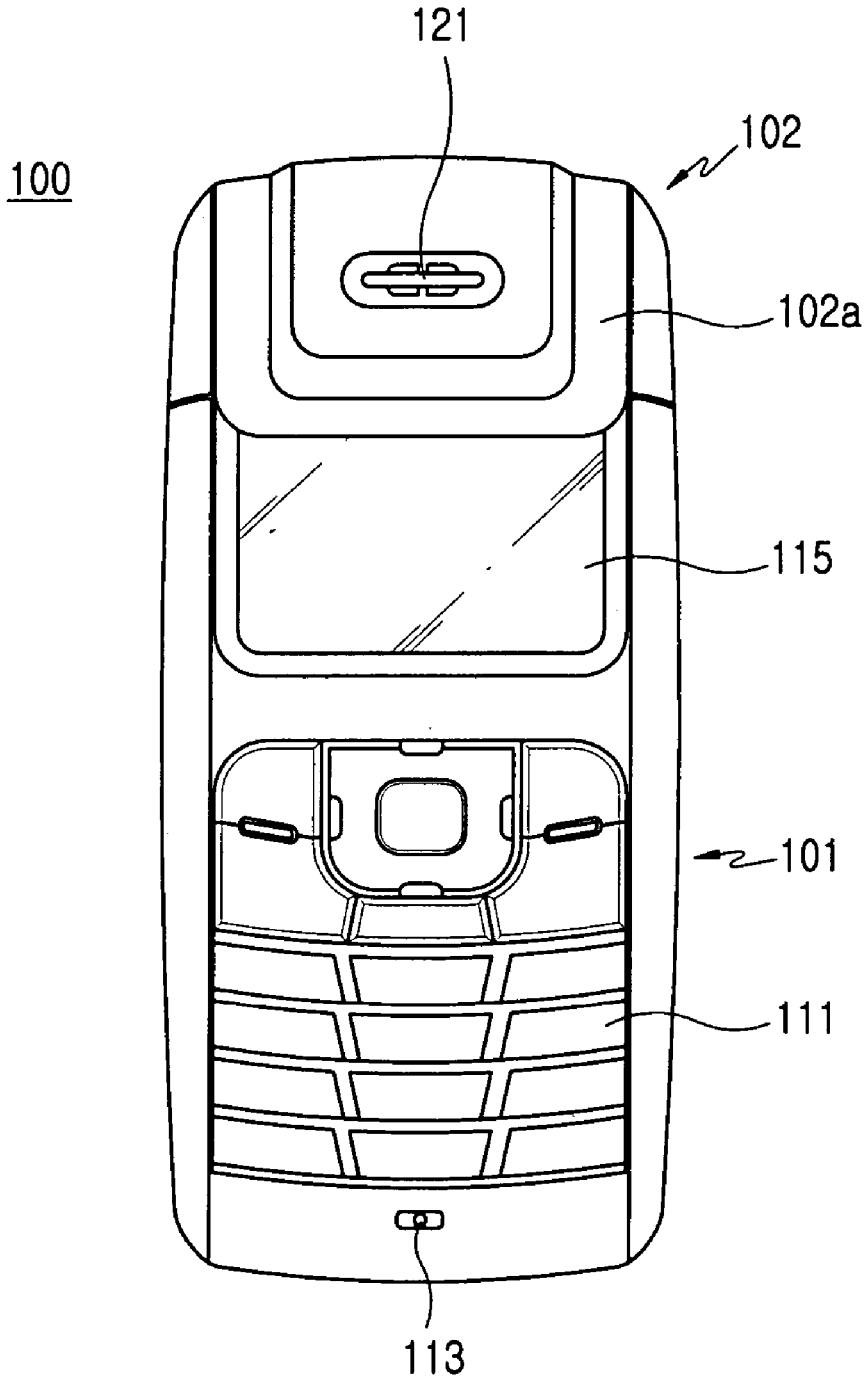
FIG. 1 is a front view showing a portable terminal having an antenna device according to a preferred embodiment of the present invention.
Figure 2:
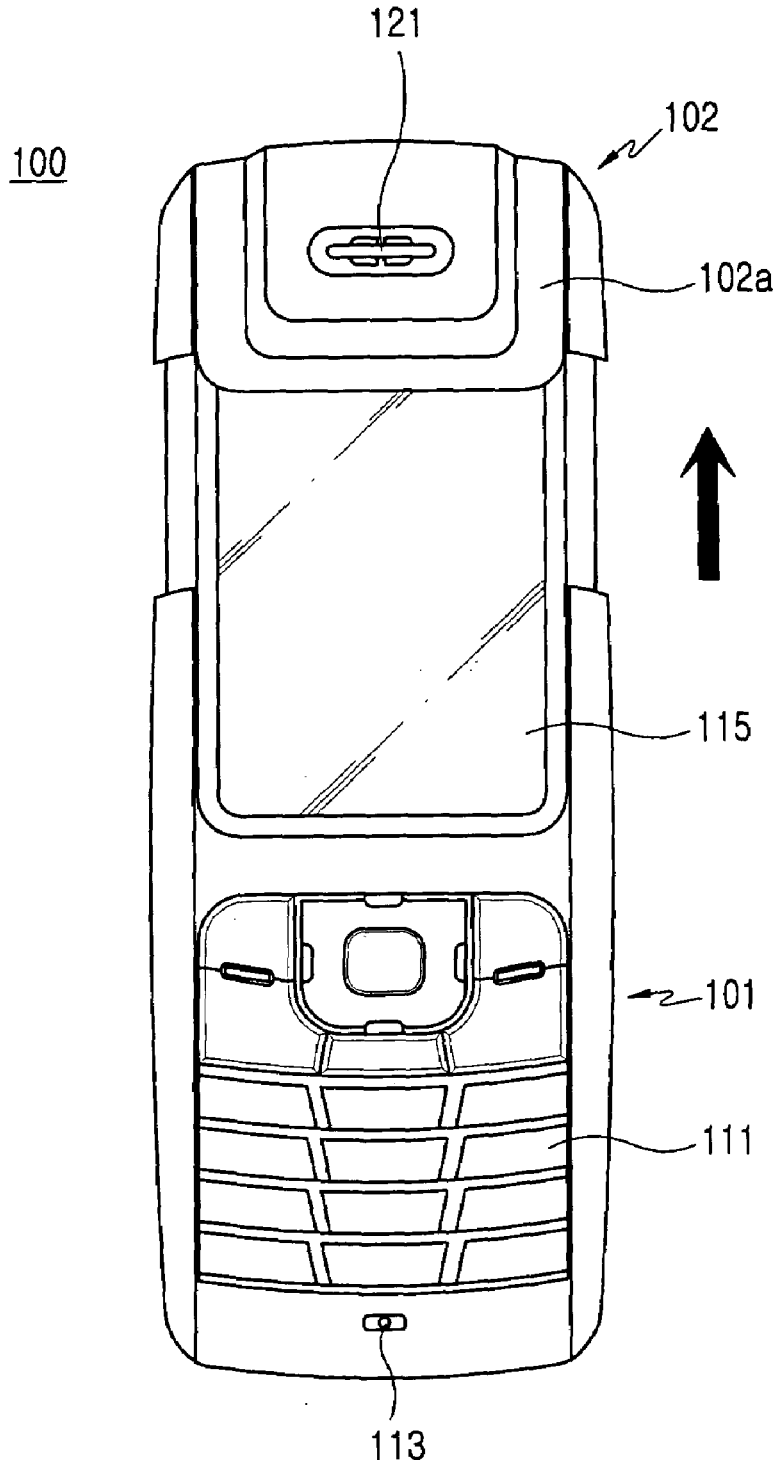
FIG. 2 is a front view showing the portable terminal shown in FIG. 1, in which a second housing is upwardly slid and moved along a first housing.
Figure 3:
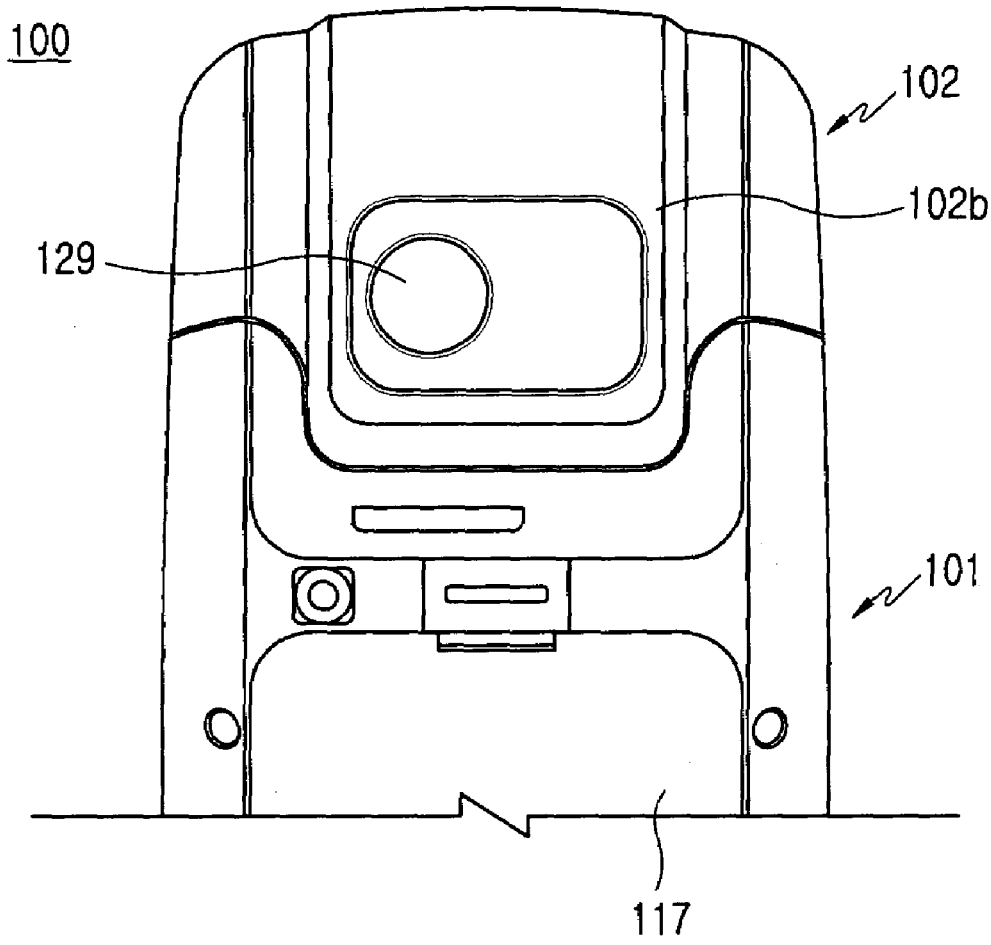
FIG. 3 is a view showing a back portion of the portable terminal shown in FIG. 1.
Figure 4:
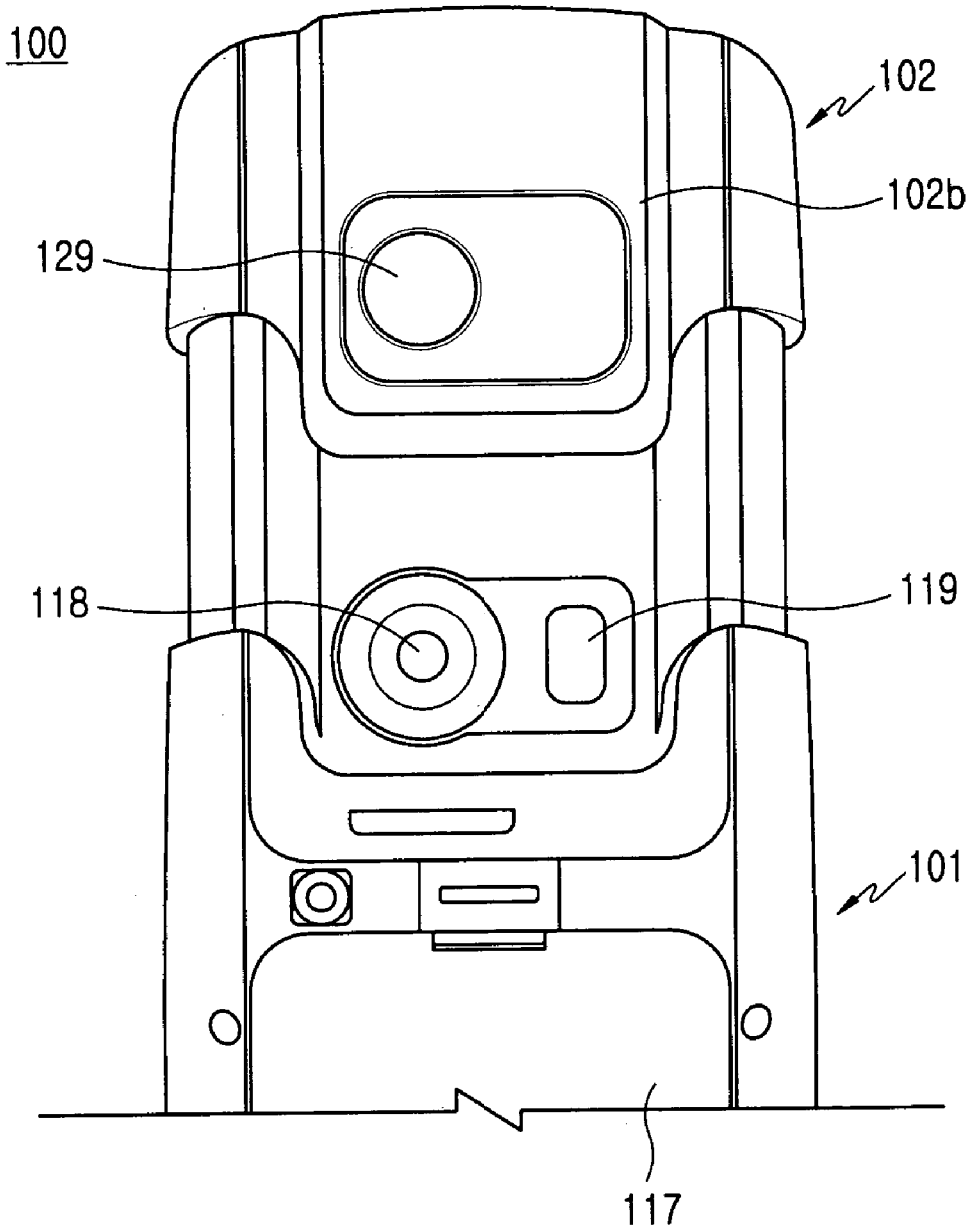
FIG. 4 is a view showing a back portion of the portable terminal shown in FIG. 2.

FIG. 1 is a front view showing a portable terminal 100 having an antenna device according to a preferred embodiment of the present invention, FIG. 2 is a front view showing the portable terminal 100 shown in FIG. 1, in which a second housing 102 is upwardly slid and moved along a first housing, and FIGS. 3 and 4 are a view showing a back portion of the portable terminal 100 shown in FIGS. 1 and 2, respectively.

As shown in FIGS. 1 to 4, the portable terminal 100 having an antenna device according to the preferred embodiment of the present invention includes a bar type of a first housing 101 having a key pad 111, a transmitting unit 113 and a display unit 115 which are arranged on a front surface of the first housing 101, and a second housing 102 which is coupled to and slidably moved along an upper portion of the first housing 101 to close and open a part of the display unit 115. The second housing 102 is assembled with the first housing 101 so as to slidably move in a lengthwise direction of the first housing 101. The second housing 102 includes a front cover 102*a* and a back cover 102*b* to enclose an upper end and upper portions of a front surface, a back surface and both sides of the first housing 101. A receiving unit 121 is installed on the front cover 102*a* of the second housing 102. A speaker unit 123 (see FIG. 5) is disposed on an inner surface of the front cover 102*a* on which the receiving unit 121. The front cover 102*a* and the back cover 102*b* (see FIG. 6) are assembled with each other by means of a plurality of connecting pins 127*a* and 127*b* respectively formed thereon.

When the second housing 102 is arranged on the first housing 101 to overlap the first housing 101 so that a part of the display unit 115 is closed, the portable terminal 100 is in the stand-by mode. In order to convert the portable terminal into a call mode, a user operates the key pad 111, or moves the second housing 102 slidably.

Referring to FIGS. 3 and 4, a receiving groove 117 for receiving a battery pack (not shown) is formed on a back surface of the first housing. Furthermore, a camera unit 118 is installed at an upper portion of the back surface of the first housing 101. A flash unit 119 is disposed adjacent to a side of the camera unit 118, which is closed and opened together with the camera unit 118 as the second housing 102 slidably moves along the first housing 101.

A reflection mirror 129 is mounted on a back surface of the second housing 102. The user can see self-images with using the reflection mirror 129 when the taking a self-portrait with the camera unit 118.

Figure 5:
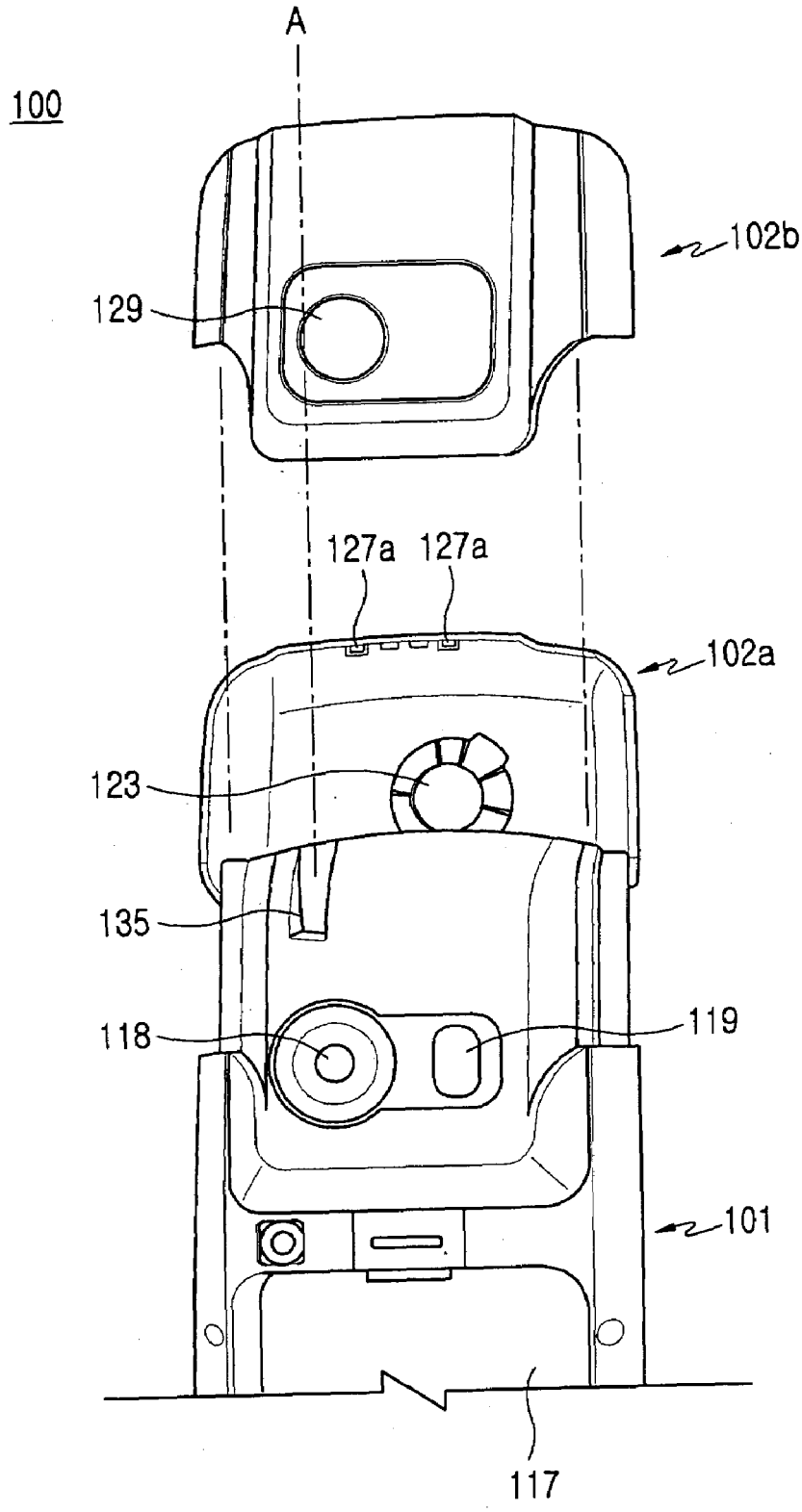
FIG. 5 is a view showing the back portion of the portable terminal shown in FIG. 4, in which a back cover is separated from the second housing.
Figure 6:
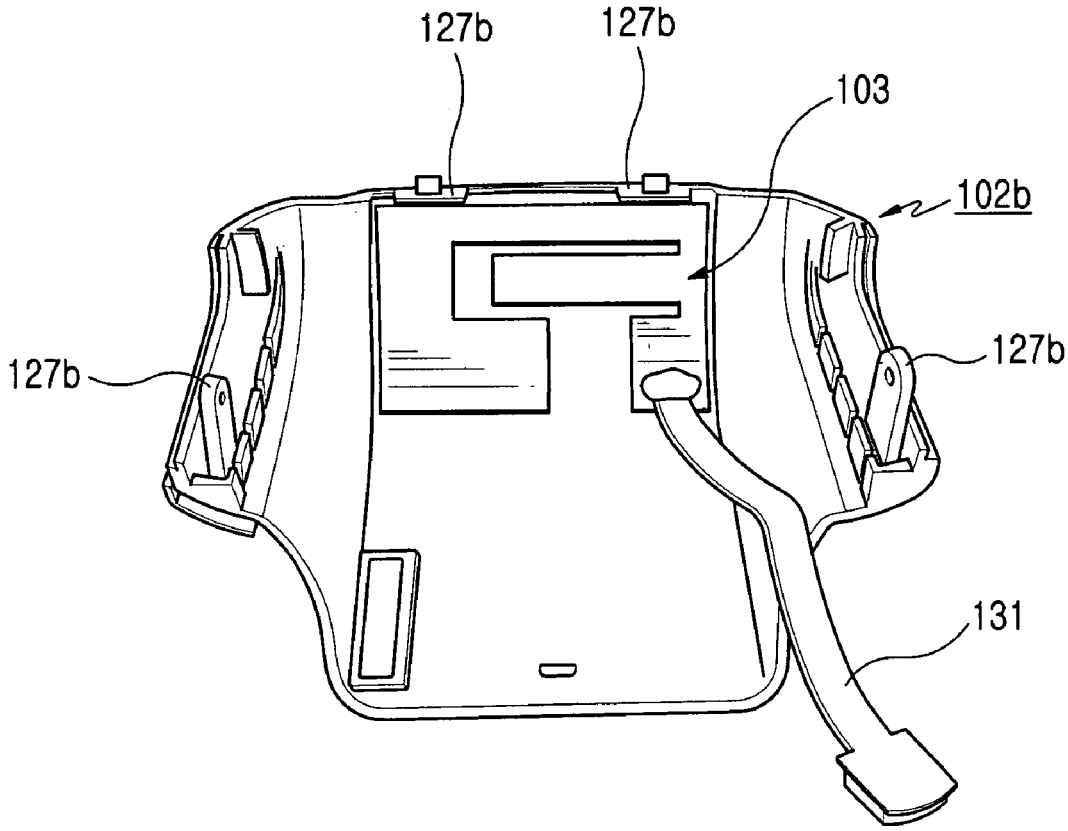
FIG. 6 is a perspective view showing an inside of the back cover which is separated from the second housing shown in FIG. 5.
Figure 7:
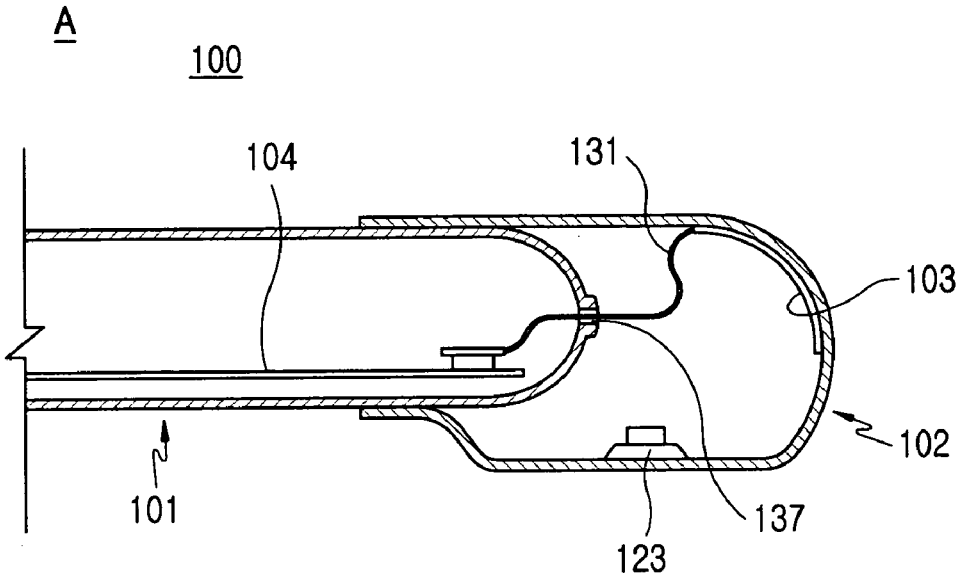
FIGS. 7 and 8 are views illustrating a structure of the antenna device of the portable terminal shown in FIG. 1.
Figure 8:
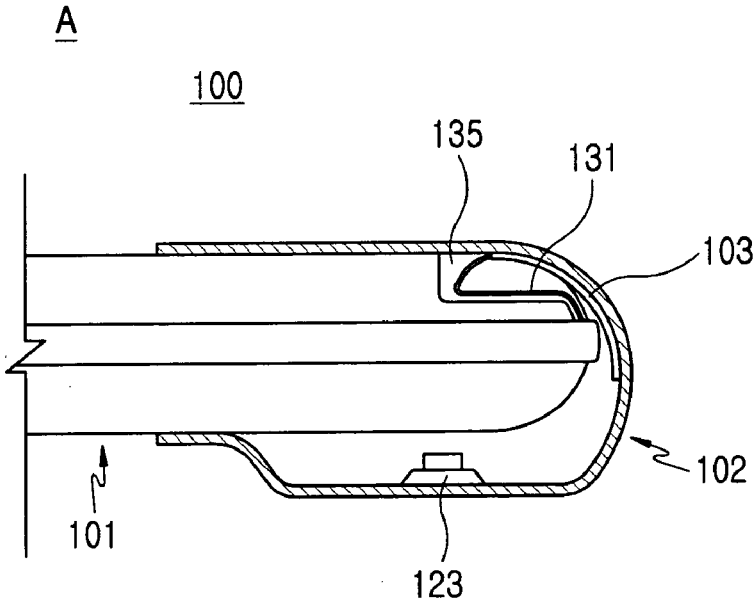

FIG. 5 is a view showing a back portion of the portable terminal 100 shown in FIG. 4, in which a back cover 102*b* is separated from the second housing 102. FIG. 6 is a perspective view showing an inside of the back cover 102*b* which is separated from the second housing 102 shown in FIG. 5. In addition, FIGS. 7 and 8 are views illustrating a structure of the antenna device of the portable terminal 100 shown in FIG. 1. FIG. 7 is a sectional view of the first and second housings 101 and 102, taken along line A of FIG. 5. FIG. 8 is a sectional view of the second housing 102, taken along line A of FIG. 5. Furthermore, FIG. 7 shows the state that the second housing 102 opens the camera unit 118 and FIG. 8 shows the state that the second housing 102 closes the camera unit 118.

As shown in FIGS. 5 to 8, an antenna device of the portable terminal 100 includes an antenna pattern 103 which is installed on the second housing 102 and a flexible printed circuit 131 which extends from the antenna pattern 103. The flexible printed circuit 131 connects the antenna pattern 103 to the portable terminal 100, more particularly to a main board 104 which is fixed in the first housing 101.

The antenna pattern 103 is installed on an inner surface of the back cover 102*b* of the second housing 102. The antenna pattern 103 is a reverse F shaped antenna which has a predetermined pattern formed by plate processing and which is attached to the inner surface of the second housing 102. However, the antenna pattern can be formed into a circuit pattern, such as a printed circuit pattern formed on a circuit board, in which conductive material is printed on the inner surface of the second housing 102.

The antenna pattern 103 can be formed in a variety of shapes suitable to a transmission/reception frequency band of the portable terminal 100.

The flexible printed circuit 131 extends from the antenna pattern 103 and enters the first housing 101. The first housing 101 has an antenna hole 137 formed at an upper end thereof in order to provide a passage for the flexible printed circuit 131. The antenna hole 137 is formed to penetrate a wall of the first housing 101 so as to communicate an inside of the first housing 101 with the outside. The flexible printed circuit 131 also operates as an assistant antenna which assists the antenna function of the antenna pattern 103, while connecting the antenna pattern 103 to the main board 104 electrically.

As the flexible printed circuit 131 entering the first housing 101 via the antenna hole 137 is connected at an end portion thereof to a connector (not shown) which is provided on the main board 104, the antenna pattern 103 makes electrical contact with the main board 104.

When the second housing 102 is slid away from the first housing 101 and the camera unit 118 is open, the antenna pattern 103 moves away from the main board 104. Therefore, the flexible printed circuit 131 has sufficient length to connect the antenna pattern 103 to the main board 104 when the first housing 101 and the second housing 102 are slidably moved apart. In the state where the second housing 102 closes the camera unit 118, however, a distance between the antenna pattern 103 and the main board 104 is relatively short. Thus, a groove 135 is formed at an upper portion on the back surface of the first housing 101 to receive a part of the flexible printed circuit 131 when the second housing 102 closes the camera unit 118.

The groove 135 for receiving the flexible printed circuit 131 is formed to have a length from the upper end to a predetermined portion of the back surface of the first housing 101, so as to receive the flexible printed circuit 131 when the second housing 102 closes the camera unit 118.

In the state where the second housing 102 closes camera unit 118, the flexible printed circuit 131 is folded and received in the groove 135. When the second housing 102 moves slidably in a direction to open the camera unit 118, the flexible printed circuit 131 unfolds from the groove 135 and is located in a space between an outer surface of the upper end of the first housing 101 and an inner surface of the first housing 101.

As a result of forming the antenna pattern 103 on the inner surface of the second housing 102 which can slidably move along the first housing 101 enclosing the first housing 101 and of connecting the antenna pattern 103 with the main board 104 of the portable terminal by means of the flexible printed circuit 131, the antenna device of the portable terminal 100 can operate stably.

In the antenna device of the portable terminal according to the present invention, as described above, since the antenna pattern is formed on the inner surface of the second housing 102 which can slidably move along the first housing 101 enclosing the first housing 101 and the antenna pattern 103 is connected with the main board 104 of the portable terminal by means of the flexible printed circuit 131, the stable connection of the antenna pattern 103 and the main board 104 can be maintained. As the groove 135 is also formed to receive the flexible printed circuit 131 at a location of the first housing 101 which is overlapped with the second housing 102, furthermore, the flexible printed circuit 134 can stably move without disturbance of other structures while it self being prevented from damage. Thus, there are advantages that the reliability of the portable terminal can be improved and the production of the portable terminal is relatively easy. Further, since the antenna pattern 103 is installed on the second housing 102 separated from the main board of the terminal and the second housing can be slidably moved along the first housing so as to pull the antenna pattern from the terminal, further, satisfactory radio reception can be obtained under a poor reception environment of radio waves.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna device for a portable terminal including a first housing and a second housing which is slidably assembled with the first housing so as to open and close a part of the first housing, the antenna device comprising:

an antenna pattern which is disposed on an inner surface of the second housing, the second housing enclosing the first housing when the first housing and the second housing have been assembled with each other; and a flexible printed circuit which extends from the antenna pattern into the first housing.

2. The antenna device for a portable terminal as claimed in claim 1, wherein the first housing has a groove formed on a surface thereof in order to receive the flexible printed circuit when the second housing closes the part of the first housing.

3. The antenna device for a portable terminal as claimed in claim 2, wherein the groove is formed on a back surface of the first housing adjacent to an upper end of the first housing.

4. The antenna device for a portable terminal as claimed in claim 1, wherein the second housing is provided for enclosing the upper end and upper portions of a front surface, a back surface and both sides of the first housing, and the antenna pattern is installed in the second housing to face the upper portion of the back surface of the first housing.

5. The antenna device for a portable terminal as claimed in claim 1, wherein the first housing includes a main board to which the flexible printed circuit extending into the first housing is connected to make the antenna pattern make electrical contact with the main board.

6. The antenna device for a portable terminal as claimed in claim 1, wherein the antenna pattern is a flat antenna having a reverse-F shape, which is attached to the inner surface of the second housing.

7. The antenna device for a portable terminal as claimed in claim 1, wherein the antenna pattern is a printed circuit pattern that is a conductive material printed on the inner surface of the second housing.

8. The antenna device for a portable terminal as claimed in claim 1, wherein the flexible printed circuit is folded in a groove when the second housing closes the part of the first housing.

9. The antenna device for a portable terminal as claimed in claim 1, wherein the first housing has an antenna hole formed at the upper end thereof in order that the flexible printed circuit extends through the antenna hole into the first housing.

* * * * *